US005836468A

United States Patent [19]

Bösl et al.

[11] Patent Number: 5,836,468

[45] Date of Patent: Nov. 17, 1998

[54] PLASTIC SNAP CLOSURE WITH ANTI-TAMPER STRIP AND METHOD OF ITS MANUFACTURE

[75] Inventors: Udo Bösl, Eimeldingen, Germany; Kelvin Pitman, Bubendorf, Switzerland

[73] Assignee: Crown Cork AG, Reinach, Switzerland

[21] Appl. No.: 663,067

[22] PCT Filed: Oct. 23, 1995

[86] PCT No.: PCT/CH95/00248

§ 371 Date: Jun. 14, 1996

§ 102(e) Date: Jun. 14, 1996

[87] PCT Pub. No.: WO96/14252

PCT Pub. Date: May 17, 1996

[30] Foreign Application Priority Data

Nov. 2, 1994 [CH] Switzerland ..... 3273/94

[51] Int. Cl.[6] ..... B65D 39/00

[52] U.S. Cl. ..... 215/253; 215/304; 215/317; 215/349; 220/266; 220/784; 220/795

[58] Field of Search ..... 215/253, 302, 215/303, 304, 317, 349; 220/266, 784, 795

[56] References Cited

U.S. PATENT DOCUMENTS

| | | | |
|---|---|---|---|
| 3,675,805 | 7/1972 | Shane | 215/253 |
| 4,333,578 | 6/1982 | Di Nunzio . | |
| 4,561,553 | 12/1985 | Crisci . | |
| 4,700,860 | 10/1987 | Li | 215/256 |
| 5,294,015 | 3/1994 | Landis | 220/306 |

FOREIGN PATENT DOCUMENTS

| | | | |
|---|---|---|---|
| 3021805 A1 | 2/1982 | Germany . | |
| 595642 | 7/1959 | Italy | 215/253 |
| 920937 | 3/1963 | United Kingdom . | |

*Primary Examiner*—Stephen Cronin
*Attorney, Agent, or Firm*—Woodcock Washburn Kurtz Mackiewicz & Norris LLP

[57] ABSTRACT

The plastic snap closure possesses a snapping means (3) on the inside surface of the cap wall (2), said snapping means being able to be snapped over a bead on the container mouth. In order to display initial opening of the closure, approximately vertical weakened zones (4) are provided on the lower edge of the closure cap. The cap wall (2) will tear on initial opening of the snap closure in the area of at least one of these weakened zones (4).

20 Claims, 5 Drawing Sheets

Figure 1:
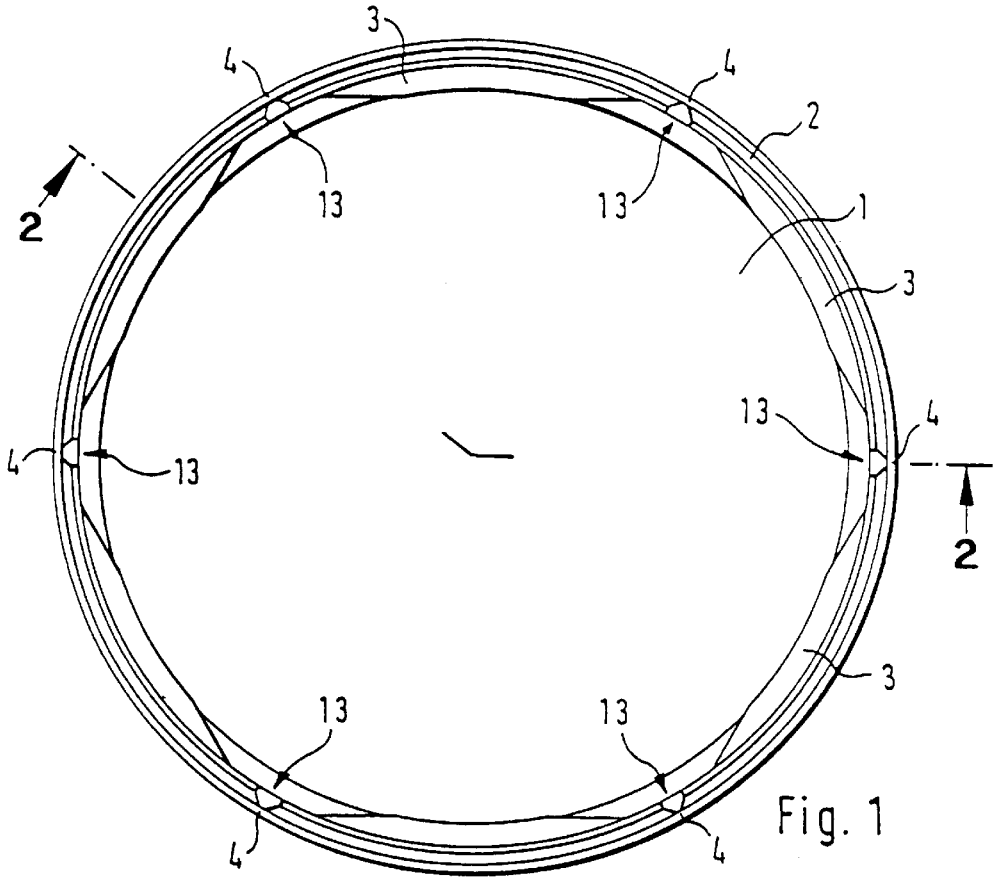

Fig. 9
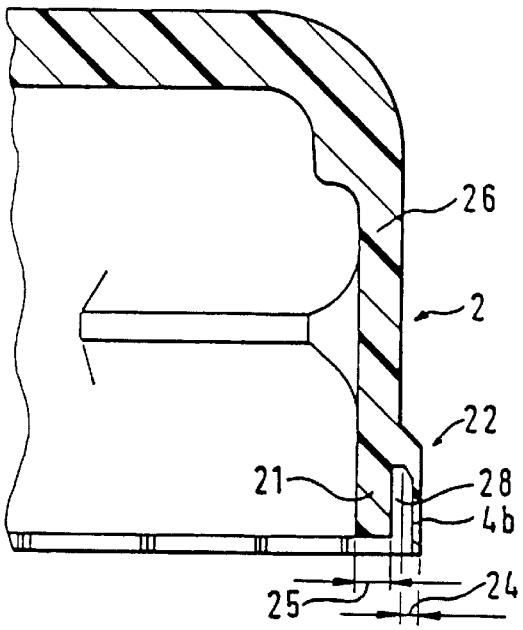
Fig. 10
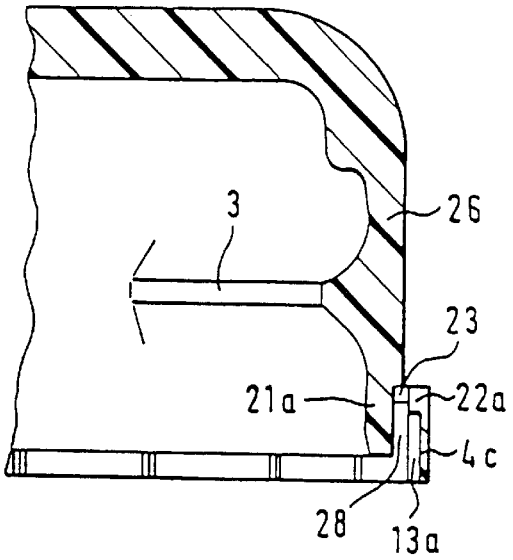
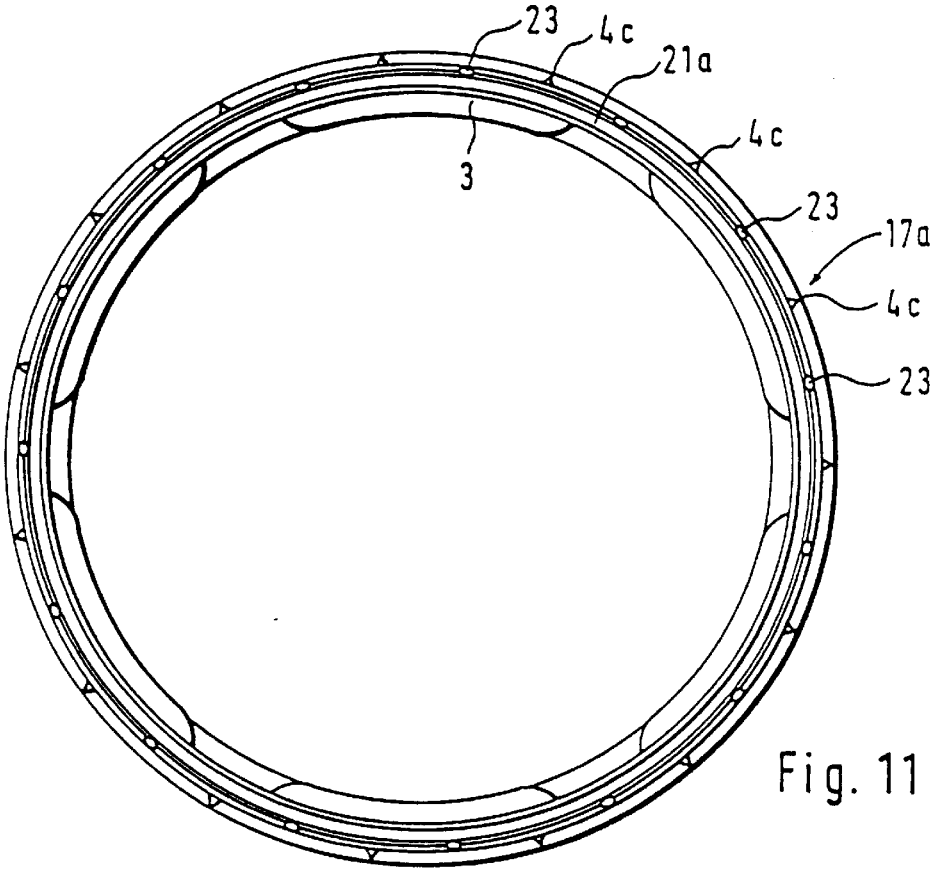
Fig. 11

PLASTIC SNAP CLOSURE WITH ANTI-TAMPER STRIP AND METHOD OF ITS MANUFACTURE

The invention relates to a plastic snap closure according to the features in the preamble to claim 1, and a method of manufacture of said snap closure. Snap closures of this type are used for the closure of containers, said containers possessing a circumferential bead on the outside of their approximately cylindrical mouth area. A main area of usage is the closure of beverage bottles, such as, for example, beer or mineral water bottles.

Containers of this type are frequently closed by means of metal crown caps, applied with the aid of suitable folding devices. The folded cap wall will extend over the bead on the container mouth when the container is closed. Opening of such a closure is achieved by lateral upward bending of the cap wall using a standard bottle opener, resulting in a plastic deformation of the cap wall. Thus, after initial opening of the container, the metallic crown cap can no longer be reliably used for reclosure.

The suggestion has therefore already been made in EP-21 036 to use a closure of synthetic resin in place of the metallic crown cap, said synthetic resin closure cap being able to snap onto the container mouth. To this end, the synthetic resin closure cap possesses a protruding collar around its inside circumference. In the case of a closed container, this collar engages over the bead on the container mouth in order to thus form a seal and close the bottle. Here too, opening of the closure is achieved with the aid of a normal bottle opener; as opposed to metallic crown caps, because the closure cap comprises an elastic material, it can be removed from the container mouth without plastic deformation of the cap wall. On opening, the cap wall is merely subjected to elastic expansion, and will subsequently return to its original shape. The closure cap can thus be repeatedly used, and the quality of the seal of the closure will not be adversely affected, even after several openings and reclosures.

Aside from their qualities in relation to the sealing of the container, it is frequently demanded of closure caps that they display the initial opening of the container in the most obvious way possible, and thus fulfil an anti-tamper function. In this respect, EP-21 036 suggests a reduction in the thickness of the cap wall in its lower area so that, on opening of the container, it will be subjected to deformation at this point by the grabbing edge of the bottle opener. Initial opening of the container will be displayed by means of this deformation. The quality and reliability of this anti-tamper function is highly dependent on the actual construction of the bottle opener employed. A bottle opener with a narrow grabbing edge, as for example used by the bottle openers incorporated into pocketknives, will lead to clear damage to the lower edge of the cap wall. As a rule, however, bottle openers employed for opening metallic crown caps tend to have a wider grabbing edge with which the plastic cap, as disclosed in EP-21 036, can be removed from a container without the cap wall being subjected to any obvious damage. The deformation of the cap wall caused by the grabbing edge can, to a considerable degree, return to its original shape after opening, so that the anti-tamper function will not be reliably ensured.

It is a purpose of the invention to improve the anti-tamper function of the state of the art snap closure, and create a plastic snap closure that, reliably and obviously, displays initial opening.

This purpose is, according to the invention, fulfilled by a plastic snap closure possessing the features described in claim 1, and a method of its manufacture possessing the features described in claims 9 or 11.

Protruding snapping means are arranged along the circumference on the inside surface of the cap wall and are able to snap over a bead on the container mouth. The radial thickness of said snapping means reaches a maximum in an annular snap-on area of the cap wall. During fitting, the closure cap is pressed onto the container mouth in the axial direction. With that, the cap wall will be subjected to elastic stretching and the snapping means of the closure cap will glide over the bead on the container mouth. As soon as the annular snap-on area, and thus the thickest point of the snapping means, has negotiated the bead, the closure cap will snap onto the container mouth. Beneath the snap-on area, the cap wall possesses at least three weakened zones running approximately vertically and distributed around the circumference, the strength of the cap wall being reduced in said zones. As a rule, the weakened zones are formed by means of an at least partial reduction in the wall thickness, as for example by means of perforation or vertical notches.

In order to remove the closure cap from the container mouth, a levering tool must be applied to the lower cap wall. The resultant loading on the cap wall will lead to tearing of the cap wall in the area of at least one of the weakened zones. This tearing will impart permanent damage to the cap wall, and clearly display initial opening of the closure cap.

The quality of the snap closure with regard to its effectiveness as a seal is primarily dependent on the strength of the snapping means protruding from the inside surface of the cap wall. In order to ensure the original quality of the seal, also on reclosure the container after initial opening, the strength of the cap wall within the annular snap-on area must not be compromised. For this reason, the vertical weakened zones are arranged beneath the snap-on area, so that the strength of the snap-on area will not be compromised, also when the cap wall in the area of one or more weakened zones is subjected to tearing.

Preferably, in order to open the snap closure, the standard bottle opener for opening metallic crown caps is used, the grabbing edge of said opener engaging on the cap wall at one side. On initial opening of the closure cap, the cap wall must tear in every case, independent of the position at which the bottle opener is applied on the circumference of the closure cap. In order to ensure this tearing, at least three vertical weakened zones are required, distributed around the circumference. Preferably, however, a greater number of weakened zones are used.

On opening the closure cap, the greatest forces will be exerted on the lower edge of the cap wall. Tearing in the area of the weakened zones is therefore facilitated if the said weakened zones extend down to the lower edge of the cap wall.

Tearing of the cap wall in the area of a weakened zone will be particularly evident if, in the area of the weakened zone, the cap wall possesses a smooth exterior surface. This can, for example, be achieved if the weakened zones are formed by depressions applied to the inside surface of the cap wall.

The cap wall will tear in the area of the weakened zone even with slight applications of force. The snap closure can therefore be designed in such a way that it can be removed from the container mouth with relatively slight application of force without adversely affecting the anti-tamper function. With a preferred embodiment, a plurality of snap elements are employed as a snapping means, said elements being arranged around the circumference on the inside surface of the cap wall, at a distance from one another. As opposed to a circumferential snap bead, this configuration has the advantage that the cap wall is more elastic and flexible in the intermediate space between the consecutive snap elements. A reduction of the force required to lift the closure cap is thus attained.

A further improvement will arise if the weakened zones are arranged in the intermediate space between consecutive snap elements. The weakened zones are thus located in an area of the cap wall that is not strengthened by the snap elements provided in its inside surface. Since this area is subjected to particular stretching when opening the cap closure, tearing of the cap wall will be additionally facilitated by means of the weakened zones arranged in this area.

In order to open the snap closure, preferably a bottle opener is employed that can also be used to open metallic crown caps. Bottle openers of this type possess a grabbing edge that engages beneath the lower edge of the cap wall at a circumferential point, and a support surface that acts in conjunction with said grabbing edge, said support surface lying on the outer surface of the cap base and serving as a counter bearing. With most bottle openers, the distance between the grabbing edge and the support surface is in most cases determined by the relatively flat metallic crown cap, and is as a rule between approximately 12–15 mm. With one of the preferred embodiments of the invention, therefore, the height of the closure cap amounts to maximum 12 mm, so that the closure can be opened with a bottle opener of the aforementioned type.

Particular demands are placed on the strength of the cap wall. During opening, the cap wall should tear in the area of the vertical weakened zones. This is achieved by forces exerted on the lower edge of the cap in the radial direction. Simultaneous distortion of the cap wall in the axial direction is, however, undesirable, since the vertical force components are mainly required to lift the closure cap. In order to restrict the axial distortion of the cap wall to an absolute minimum, the cap wall is preferably designed in such a way that its outside surface possesses a plurality of ribs protruding radially outwards, distributed around the circumference. Axial resistance to loading of the cap wall is raised by this means. Because the load imparted by a bottle opener is at its greatest at the lower edge of the cap, the ribs are preferably designed in such a way that they extend to the lower edge of the cap. This has the simultaneous advantage that the contact area available for the grabbing edge of the bottle opener at the lower edge of the cap is larger in the area of the ribs. The provision of ribs on the cap wall will lead to an enlargement of the wall thickness in the area of said ribs; the least possible wall thickness is aimed at within the vertical weakened zones: the weakened zones are therefore preferably arranged in the intermediate space between consecutive ribs.

A second possibility for improvement of the axial resistance to loading of the cap wall comprises the formation of the lower area of the cap wall, which possesses weakened zones, by two concentric annular elements. With that, in its lower area which is provided with weakened zones, the cap wall comprises an inner support ring and an anti-tamper ring arranged to surround said support ring concentrically. The approximately vertical weakened zones are here provided on the outer anti-tamper ring. On initial opening, a destruction primarily of the outer anti-tamper ring will thus be achieved, with the more stable support ring absorbing the vertical forces of the bottle opener. The concentric rings are therefore preferably so designed that solely the outer anti-tamper ring possesses weakened zones, while the inner support ring is not weakened by the weakened zones and thus possess greater strength.

In order to ensure that the outer anti-tamper ring is also actually destroyed on initial opening of the closure, a snap closure according to this embodiment of the invention is preferably designed in such a way that the anti-tamper ring extends further below the lower edge of the support ring. The basic aforementioned principles for the design of the weakened zones also apply in the case where the said weakened zones are applied to an anti-tamper ring of the aforementioned type. Preferably, the weakened zone is in this case also formed by a depression provided on the inside surface of the anti-tamper ring, the anti-tamper ring possessing a smooth outside surface in the area of the weakened zones. This has the advantage that tearing is immediately recognisable from outside.

When selecting the dimensions of the anti-tamper ring and the inner support rings, the varying functions of these wall elements are to be considered. Preferably, the size relationships are so selected that the radial thickness of the anti-tamper ring is less that the radial thickness of the support ring.

The connection between the individual wall elements can also be designed in various ways. Wall elements are, in this connection, three elements: namely, the support ring; the anti-tamper ring surrounding the support ring; and the upper portion of the cap wall. The upper portion of the cap wall can, in this connection, also be regarded as a third annular element and will, in the following, be characterised as the "wall ring". With the design of the connections, once again the function of the individual elements must be allowed for. The support ring must transmit the axial forces of the bottle opener onto the upper wall ring (on which the snap elements of the snap closure are arranged). The support ring is therefore preferably formed as a direct extension of the upper wall ring, so that the support ring, together with the upper wall ring, forms a continuous wall section. Slightly varying diameters of support ring and wall ring are nevertheless possible: in particular, the outside diameter of the support ring in relation to that of the wall ring is preferably somewhat reduced, in order to accommodate the outer anti-tamper ring.

In the same way as the support ring, the outer anti-tamper ring can likewise be connected with the upper wall ring of the cap wall. Alternatively, the anti-tamper ring can also be connected to the remainder of the cap wall solely by means of a plurality of elastic bridge pieces distributed around the circumference. The term "the remainder of the cap wall" implies the wall ring and the support ring that buts onto said wall ring. Through the use of bridge pieces as a connection, the radial flexibility of the anti-tamper ring will be further increased so that, on initial opening of the closure by the bottle opener, said anti-tamper ring will be more easily pressed outwards by the bottle opener, with the vertical weakened zones tearing more rapidly as a result.

If the anti-tamper ring is connected to the remainder of the cap wall by bridge pieces, then these bridge pieces can in addition assume an anti-tamper function: the connecting bridge pieces are here so designed that, on initial opening, individual bridge pieces will rupture. In order to enable rupturing, an anti-tamper ring is required with an inside diameter that is greater than the maximum outside diameter of the remainder of the cap wall. The bridge pieces are, with that, preferably arranged between the inside surface of the anti-tamper ring and the outside surface of the support ring. The force required to rupture the anti-tamper ring is determined by the number and the thickness of the bridge pieces.

The weakened zones are designed in such a way that tearing of the cap wall, in particular in its lower area, is easily recognisable. According to an embodiment already described, the weakened zone is preferably designed in such a way that the outside surface of the cap wall possesses a smooth surface. A tear will be easily recognisable on the smooth outside surface.

The cap wall will tear with particular ease if perforations are provided in the upper area of the weakened zone, so that a rupturable bridge piece will be formed between each perforation point and the lower edge of the cap wall. Once again, a smooth outside surface is preferred in the area of the bridge pieces, since a tear will then be particularly easy to recognise.

Particularly economical and efficient production can be attained if the snap closure is manufactured in one piece from plastic.

In addition to the initial fitting of the snap closure by snapping said closure cap onto the container mouth as described in the introduction, other fitting methods are also conceivable, with which the closure cap, after placement on the container mouth, is distorted by means of external heating and brought to its final shape. This deformation can either be achieved through the use of a heat-shrinking plastic or by the external application of force. For example, a pair of electrically heated fitting tongs could be employed, said tongs deforming the cap wall after placement on the container mouth. The weakened zones can also be subsequently applied in this way.

A simple variation in manufacturing the previously described snap closure comprises the casting of the entire snap closure, including the vertical weakened zones, in a single working step. Depending on the desired design of the weakened zones, it can however be of advantage to apply the weakened zones only subsequently. To this end, a closure with a cap base, an abutting cylindrical cap wall and, on the inside surface of said cap wall, a snapping means protruding around the circumference, is first of all cast in a single working step. Subsequently, in a further working step, at least three approximately vertical weakened zones are applied to the lower area of the cap wall. The application of the weakened zones can, for example, ensue with the aid of a cutting tool by means of cutting or grinding. Alternatively, it is also possible to apply the weakened zones through subsequent heat deformation or melting using a heated tool, for example. The application of the weakened zones can, with that, ensue either prior to or after placement of the closure cap on the container mouth.

In an alternative method of manufacture of a snap closure, first of all a closure cap is produced in a single casting procedure, the cap wall of said closure possessing a plurality of slots extending vertically upwards from its lower edge. These slots are at least partially reclosed through deformation of the cap wall and/or filling with plastic material so that, in the area of the slots, a weakened zone of the cap wall will remain. The plastic material used for filling the slots can be a liquid or paste-like adhesive that will subsequently dry or cure. However, a thermoplastic material can also be used that, in the heated state, is filled into the slots and subsequently resolidifies. With this embodiment, a reopening of the slots during fitting of the snap closure can be prevented by closing off the slots only after fitting of the snap closures.

The invention is more closely described in the following, on the basis of various embodiments: namely, FIG. 1 A plan view from below of the snap closure according to the invention, FIG. 2 a cross-section along the line A—A according to FIG. 1, FIG. 3 a cross-section of a container mouth closed by a snap closure, with bottle opener in position, FIG. 4 the arrangement shown in FIG. 3, after raising of the snap closure, FIG. 5 a perspective view of a snap closure after initial opening, FIG. 6 a side view of a snap closure with a preferred alternative design of the weakened zones, FIG. 7 a snap closure mounted on a container mouth, with radially protruding ribs on the outside surface of the cap wall, FIG. 8 a view from below of the closure cap according to FIG. 7, FIG. 9 the edge area of a snap closure, the cap wall of which comprises, in its lower area, a support ring and an anti-tamper ring.

FIG. 10 a snap closure with an anti-tamper ring, said anti-tamper ring being connected with the remainder of the cap wall by bridge pieces, and FIG. 11 a view from below of the snap closure according to FIG. 10.

FIG. 1 shows a snap closure according to the invention from below, with a view of the inside surface of the cap base 1. Around the circumference, a plurality of snap elements 3 are arranged on the inside surface of the cap wall 2, said snap elements engaging beneath a bead on the container mouth during placing on the container mouth. The vertical weakened zones 4 are formed by notches 13 on the inside surface of the cap wall 2, said notches being arranged in the intermediate space between consecutive snap elements 3.

Figure 2:
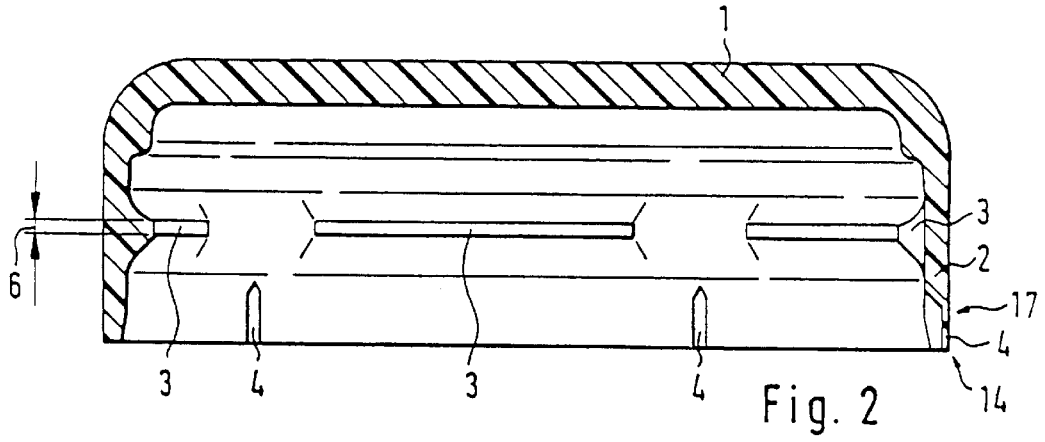

FIG. 2 shows a cross-sectional representation of the snap closure according to FIG. 1, with the plane of the cross section running along the line A—A shown in FIG. 1. The notches 13 are provided on the inside surface of the cap wall 2, so that the cap wall possesses a smooth surface 17 in the area of the weakened zones 4. Tearing of the cap wall is thus particularly easy to recognise from outside. The notches 13 extend down to the lower edge 14 of the cap wall 2.

Figure 3:
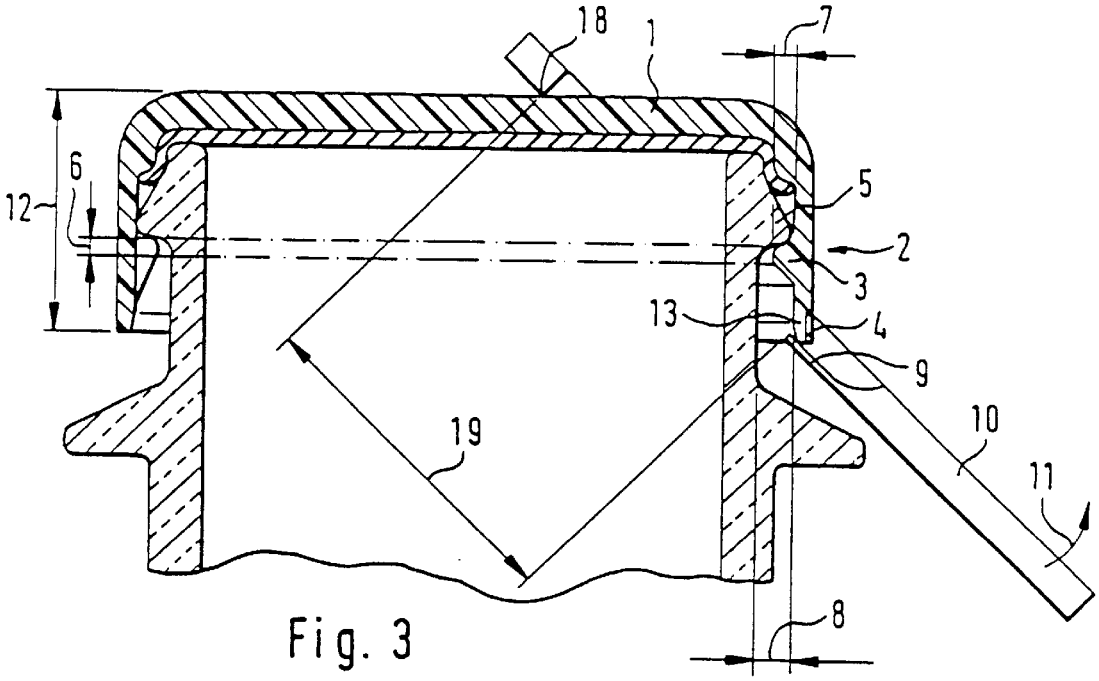
Figure 4:
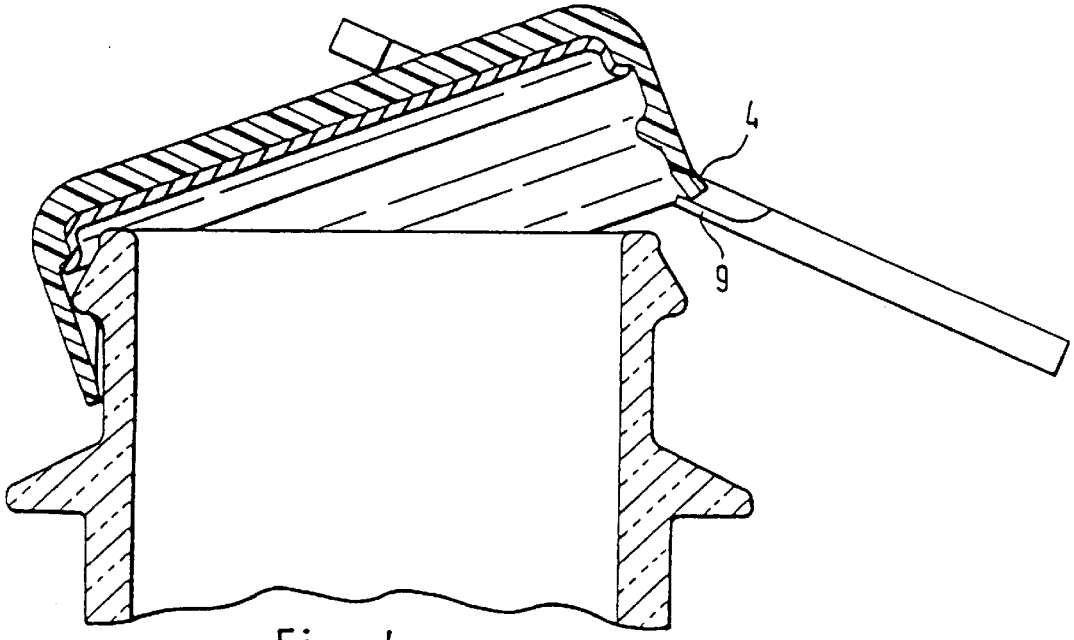

FIG. 3 shows a cross-sectional representation of a container mouth with a snap closure fitted. The snap elements 3 engage beneath a bead 5 of the container mouth. The annular snap-on area 6, in which the radial thickness of the snap elements 3 reaches its maximum 7, is of particular significance for the attachment of the closure cap. A weakening of the cap wall 2 in the area of the annular snap-on area 6 would markedly reduce the attainable quality of the seal. The weakened zones 4 formed by notches 13 are thus arranged beneath the annular snap-on area 6 of the cap wall 2.

In addition, a bottle opener 10 is also shown in FIG. 3, in a position on the snap closure for opening the container. The grabbing edge 9 of the bottle opener engages beneath a point on the lower edge of the closure cap. The grabbing edge 9 is connected with a contact area 18 of the bottle opener, said contact area resting upon the outside surface of the cap base 1. Since, with standard bottle openers that are also used for opening metal crown caps, the distance 19 between the grabbing edge 9 and the contact area 18 is usually in the region of 12–15 mm, the plastic snap closures are preferably also designed in such a way that their height 12 amounts to a maximum of 12 mm. Furthermore, opening by means of a bottle opener is advantageous if, between the inside surface of the cap wall and the outside surface of the container neck, there is a distance 8, so that the grabbing edge 9 of the bottle opener can engage behind the lower edge of the cap wall as firmly as possible.

If the bottle opener 10 as shown in FIG. 3 is moved in the direction of the arrow 11, the grabbing edge 9 will at the same time be pressed against the underside of the cap wall, which will eventually result in the snap closure being lifted on one side from the container mouth. An arrangement in this condition is shown in FIG. 4. The point where the grabbing edge 9 makes contact with the cap wall has been pressed outwards. The cap wall has therefore been torn in the area of the weakened zone 4 lying near the grabbing edge 9, so that initial opening of the closure cap can be immediately recognised. In the case of the example shown in FIGS. 3 and 4, the grabbing edge 9 of the bottle opener makes contact with the cap wall 2 exactly within the area of a weakened zone 4. In the area of the weakened zone 4, however, the cap wall is sufficiently easily tearable that, when the bottle opener is applied between two neighbouring weakened zones, the cap wall will also tear in the area of the next adjacent weakened zone.

Figure 5:
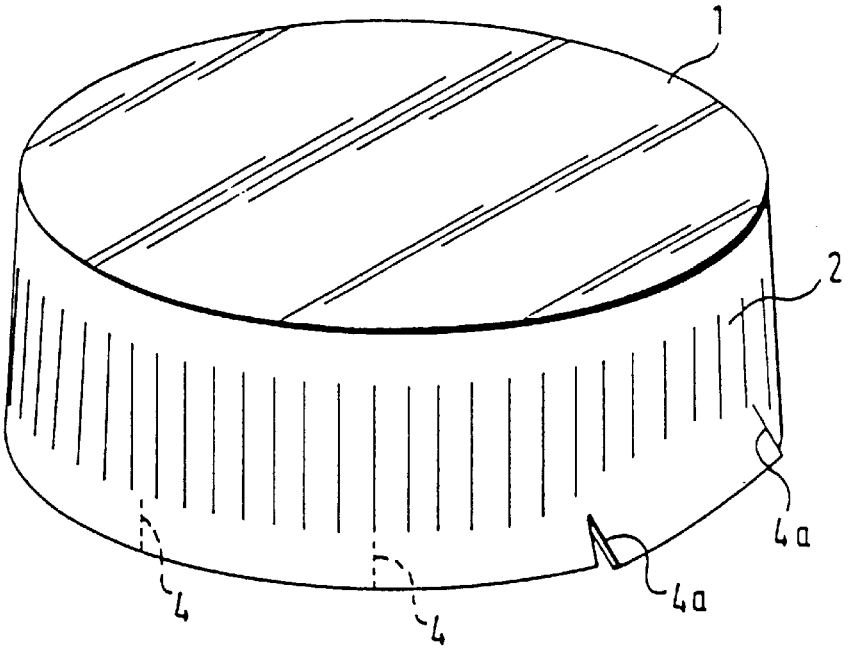

FIG. 5 shows a perspective view of a snap closure after initial opening. The cap wall 2 has been torn in the area of two vertical weakened zones 4*a*. Such a situation will arise if the bottle opener is applied between these two weakened zones 4*a* during opening of the closure. The tears in the cap wall are unmistakable and ensure a reliable anti-tamper function.

Figure 6:
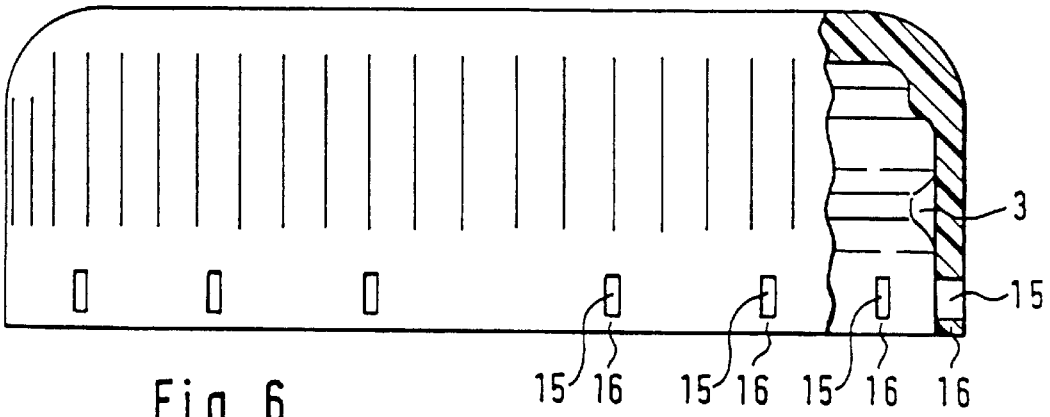

FIG. 6 shows a side view of an alternative embodiment of a snap closure with which the cap wall is perforated in the upper area of the weakened zones. Beneath each perforation point 15 is a rupturable bridge piece 16. This embodiment has the advantage that the portion of the cap wall to be ruptured will be concentrated on the bridge piece 16, and thus onto the lower edge area of the cap wall. Since the load arising on opening is greatest at the lower edge of the cap wall, the bridge pieces 16 will rupture particularly rapidly. A further improvement could be achieved by reducing the radial thickness of the bridge pieces 16. This is advantageously achieved by applying an additional notch on the inside surface of the cap wall in such a way that, in the area of the bridge pieces 16, the cap wall still possesses a smooth exterior surface.

Figure 7:
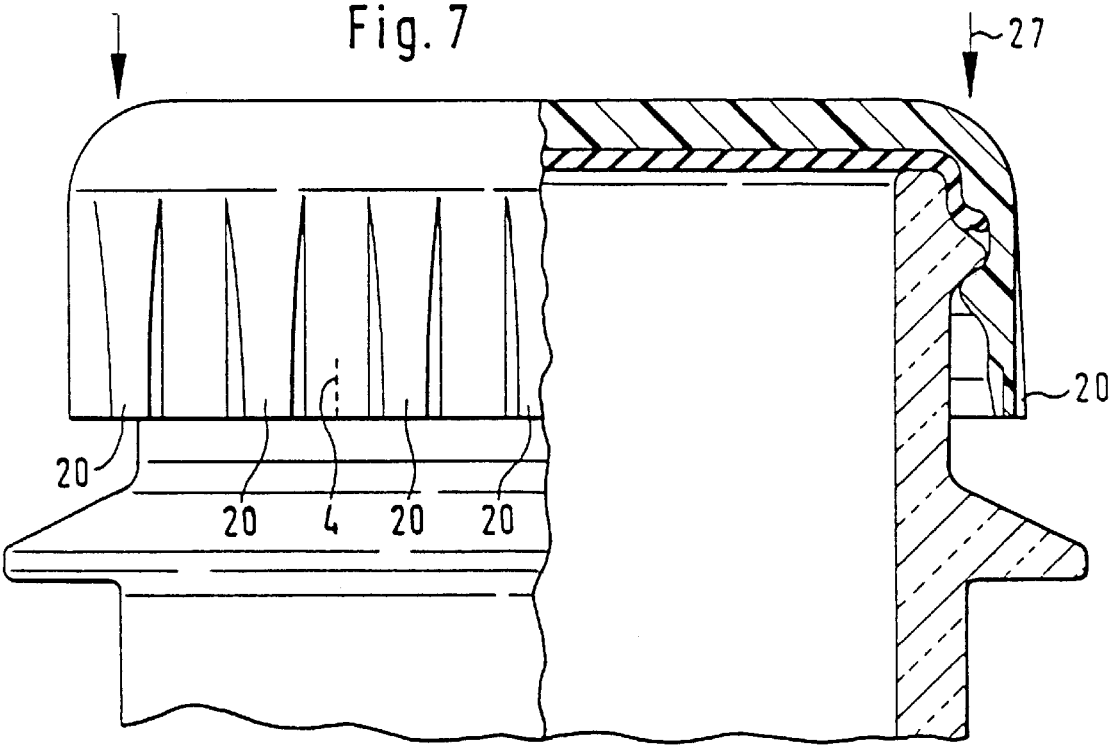
Figure 8:
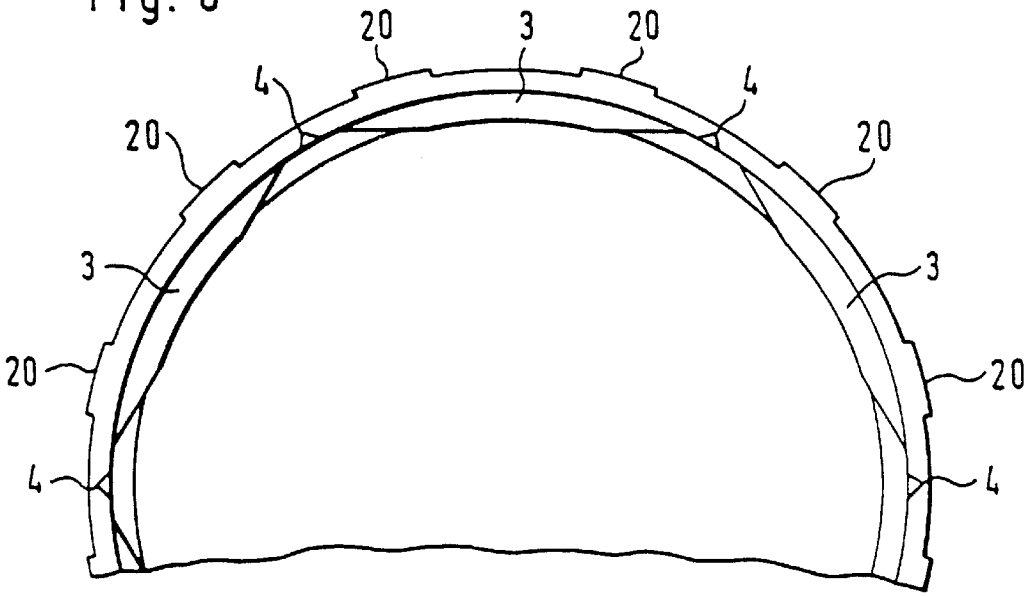

FIG. 7 shows a snap closure fitted to a container mouth, the cap wall of said closure cap possessing a plurality of ribs protruding radially outwards and distributed around the circumference. In the left half of FIG. 7, the exterior view of the snap closure is shown, with a section being shown in the right half. Increased resistance of the cap wall to axial loads 27 is achieved by means of the longitudinal ribs 20 running approximately vertically on the outside surface of the cap wall. Since the ribs 20 extend down to the lower edge of the cap wall, the contact area available for applying the bottle opener will at the same time be enlarged. This can also be seen in FIG. 8, in which the closure cap according to FIG. 7 can be seen from below. The vertical weakened zones 4 are in each case arranged in an intermediate space between two neighbouring ribs 20. The weakened zones 4 are formed by notches on the inside surface of the cap wall. In the intermediate space between neighbouring ribs 20, the cap wall has a smooth surface, so that tearing of a weakened zone is easily recognisable from outside.

FIG. 9 shows a sectional view of the edge area of a closure cap, the cap wall of which, in its lower area, comprises a support ring 21 and an anti-tamper ring 22 surrounding said support ring concentrically, said lower area being provided with weakened zones 4*b*. The weakened zones 4*b* are, with that, provided on the outer anti-tamper ring 22. These weakened zones are formed by means of notches 13*a* on the inside surface of the anti-tamper ring, so that the anti-tamper ring retains its smooth surface in the area of the weakened zones, and tearing of a weakened zone is easily recognisable. The anti-tamper ring 22 extends downwards beyond the lower edge of the support ring 21. Thus, gripping of the anti-tamper ring 22 can still be achieved by a standard bottle opener which as a rule engages on the inside edge of the support ring 21 (also see FIG. 3). The radial thickness 24 of the anti-tamper ring 22 is considerably less than the radial thickness 25 of the support ring 21. Allowance is thus made for the anti-tamper ring 22 to be as fragile as possible, and for the inner support ring 21 to have the required strength to transmit the lifting force exerted by the bottle opener.

In addition to the inner support ring 21 and the outer anti-tamper ring 22, the cap wall of this embodiment of a snap closure also possesses an upper cap wall which, in principle, is likewise an annular section, and will be referred to as the "wall ring" 26 in the following. The cap wall thus basically comprises three mutually connected elements. The support ring 21 shown in FIG. 9 represents a direct continuation of the upper wall ring 26, both ring elements possessing the same inside diameter. The outer anti-tamper ring 22 is separated from the inner support ring 21 by a similarly annular intermediate space 28. For technical manufacturing reasons, this annular intermediate space 28 is necessary when the entire closure cap is cast in one piece from plastic. At its lower end, the outside diameter of the wall ring 26 assumes the same outside diameter of the anti-tamper ring 22, so that the anti-tamper ring (as too the support ring 21) is likewise connected with the upper wall ring at its face.

FIG. 10 shows an alternative embodiment of a snap closure with a support ring 21*a* and anti-tamper ring 22*a*. Here, the inside diameter of the anti-tamper ring 22*a* is greater than the maximum outside diameter of the remainder of the cap wall. The anti-tamper ring 22*a* is connected to the remainder of the cap wall solely by means of a plurality of elastic bridge pieces 23, said bridge pieces being arranged to be distributed around the circumference. The expression "remainder of the cap wall" is, in this respect, a collective term for the support ring 21*a* and the upper wall ring 26. With the example shown, the bridge pieces 23 are arranged between the inside surface of the anti-tamper ring 22*a* and the outer surface of the support ring 22*a*.

Finally, FIG. 11 shows a view from below of a snap closure according to FIG. 10. Note that with this embodiment the same number of bridge pieces 23 and vertical weakened zones 4*c* of the anti-tamper ring 22*a* are provided, a connecting bridge piece 23 being arranged between any two vertical weakened zones 4*c*.

Inasmuch as the invention is subject to modifications and variations, the foregoing description and accompanying drawings should not be regarded as limiting the invention, which is defined by the following claims and various combinations thereof:

We claim:

1. Plastic snap closure for containers with a substantially cylindrical mouth area, with a cap base (1) and a cap wall (2) abutting onto said cap base, said cap wall having a circumference, an inside surface, an outside surface, and a lower edge (14), protruding snapping means (3) being arranged along the circumference on the inside surface of said cap wall, said snapping means being able to snap over a bead (5) on the container mouth, said snapping means having a radial thickness wherein the radial thickness of said snapping means reaches a maximum (7) within an annular snap-on area (6) of the cap wall, and vertical weakened zones (4) are formed as depressions on the cap wall and are arranged beneath the snap-on area (6) in order to break when a bottle opener is applied to a lower edge of the cap wall.

2. Snap closure according to claim 1, characterized in that the weakened zones (4) extend down to the lower edge (14) of the cap wall (2).

3. Snap closure according to claim 1, characterized in that the weakened zones (4) are formed by means of depressions (13) provided on the inside surface of the cap wall (2) and that the cap wall (2) possesses a smooth outside surface in the area of the weakened zones (4).

4. Snap closure according to claim 1, characterized in that the cap wall (2) is perforated in the upper area of the weakened zones (4), so that in each case a tearable bridge piece (16) is located between the perforation points (15) and the lower edge of the cap wall.

5. Snap closure according to claim 1, characterized in that the outside surface of the cap wall possesses a plurality of radially outwardly protruding ribs (20) distributed around the circumference, said ribs extending to the lower edge of the cap.

6. Snap closure according to claim 1, characterized in that the height (12) of the closure cap amounts to a maximum of 12 mm so that said closure cap can be removed from a container mouth by a bottle opener that can also be used to remove metallic crown caps.

7. Snap closure according to claim 1, characterized in that the snapping means are a plurality of snap elements (3) arranged along the circumference on the inside surface of the cap wall, separated at a distance from one another.

8. Snap closure according to claim 7, characterized in that the weakened zones (4) are arranged between consecutive snap elements (3).

9. Snap closure according to claim 1, characterized in that the cap wall comprises, in the area provided with weakened zones, an inner support ring (21) and an anti-tamper ring (22) arranged to surround said support ring concentrically, and that the weakened zones are provided on the anti-tamper ring (22), said anti-tamper ring having an inside surface and outside surface.

10. Snap closure according to claim 9, characterized in that the anti-tamper ring (22) extends downwards beyond the lower edge of the support ring (21).

11. Snap closure according to claim 9, characterized in that the weakened zones (4) are formed by depressions **(13*a*) provided on the inside surface of the anti-tamper ring (22) and that the anti-tamper ring possesses a smooth outside surface (17*a*)** in the area of the weakened zones.

12. Snap closure according to claim 9, characterized in that the radial thickness (24) of the anti-tamper ring is less than the radial thickness (25) of the support ring.

13. Snap closure according to claim 9, characterized in that the anti-tamper ring **(22*a*) is connected with the remainder of the cap wall solely by means of a plurality of elastic bridge pieces (23)** arranged to distributed around the circumference.

14. Snap closure according to claim 9, characterized in that the inside diameter of the anti-tamper ring **(22*a*)** is greater than the maximum outside diameter of the remainder of the cap wall.

15. Method of manufacture of a snap closure according to claim 1, characterized in that first of all a closure with a cap base (1), a cylindrical cap wall (2) abutting onto said cap base and a protruding snapping means (3) along the circumference on the inside surface of said cap wall, is manufactured in a single casting procedure and that subsequently at least three substantially vertical weakened zones are applied in the lower area of the cap wall.

16. Method according to claim 15, characterized in that the vertical weakened zones (4) are applied with the aid of a cutting tool by means of cutting or grinding and heat deformation, respectively melting.

17. Method according to claim 15, characterized in that the vertical weakened zones (4) are applied with the aid of a cutting tool by means of cutting or grinding or heat deformation, respectively melting.

18. Method of manufacture of a snap closure according to claim 15, characterized in that first of all a closure with a cap base (1) and a cylindrical cap wall (2) with a snapping means (3) on its inside surface, is manufactured in a single casting procedure, wherein the cap wall possesses a plurality of slots extending vertically upwards from the lower edge of said cap wall, and wherein said slots are at least partially reclosed by means of deformation of the cap wall and/or by means of filling with a plastic material so that a weakened zone of the cap wall remains in the area of said slots.

19. Method according to claim 18, characterized in that the slots are closed off only after fitting of the snap closure.

20. Method according to claim 18, characterized in that a liquid or paste-like filler is filled into the slots for closure of said slots, said filler curing after a period of time.

* * * * *

UNITED STATES PATENT AND TRADEMARK OFFICE

CERTIFICATE OF CORRECTION

PATENT NO. : 5,836,468

DATED : November 17, 1998

INVENTOR(S) : Bösl et al.

It is certified that error appears in the above-indentified patent and that said Letters Patent is hereby corrected as shown below:

On the title page,

Column 1, Line 15, delete "3273/94" and insert --3273/94-8 -- therefor.

Column 1, Line 42, delete "fulfil" and insert --fulfill-- therefor.

Column 2, Line 2 delete "claims 9 or 11." and insert --claims 10 or 11.-- therefor Column 2, Line 31, delete "on reclosure the container" and insert --on reclosure of the container-- therefor.

Column 4, Line 19, delete "is less that the radial" and insert -- is less than the radial-- therefor.

Column 10, Line 7, delete "arranged to distributed around the" and insert --arranged to be distributed around the-- therefor.

Signed and Sealed this

Third Day of August, 1999

*Attest:*

*Attesting Officer*

Q. TODD DICKINSON

*Acting Commissioner of Patents and Trademarks*